US008522863B2

(12) United States Patent
Tiernan et al.

(10) Patent No.: US 8,522,863 B2
(45) Date of Patent: Sep. 3, 2013

(54) PROPELLANT FRACTURING SYSTEM FOR WELLS

(75) Inventors: John P. Tiernan, Newnan, GA (US); Guy B. Spear, Marshall, VA (US); Don Landis, Hampton, GA (US)

(73) Assignee: Propellant Fracturing & Stimulation, LLC, Peachtree City, GA (US)

( * ) Notice: Subject to any disclaimer, the term of this patent is extended or adjusted under 35 U.S.C. 154(b) by 553 days.

(21) Appl. No.: 12/756,695

(22) Filed: Apr. 8, 2010

(65) Prior Publication Data

US 2010/0258292 A1 Oct. 14, 2010

Related U.S. Application Data

(60) Provisional application No. 61/238,773, filed on Sep. 1, 2009, provisional application No. 61/219,670, filed on Jun. 23, 2009, provisional application No. 61/183,176, filed on Jun. 2, 2009, provisional application No. 61/172,615, filed on Apr. 24, 2009, provisional application No. 61/167,663, filed on Apr. 8, 2009.

(51) Int. Cl.
*E21B 29/02* (2006.01)
*E21B 43/263* (2006.01)

(52) U.S. Cl.
USPC ..... 166/63; 166/299

(58) Field of Classification Search
USPC ..... 166/63, 299; 102/310, 313, 314, 102/320, 331, 332
See application file for complete search history.

(56) References Cited

U.S. PATENT DOCUMENTS

| | | | | |
|---|---|---|---|---|
| 4,633,951 | A | 1/1987 | Hill et al. | |
| 4,683,943 | A | 8/1987 | Hill et al. | |
| 4,718,493 | A | 1/1988 | Hill et al. | |
| 5,005,649 | A | 4/1991 | Smith et al. | |
| 5,295,545 | A | 3/1994 | Passamaneck | |
| 5,775,426 | A | 7/1998 | Snider et al. | |
| 6,082,450 | A | 7/2000 | Snider et al. | |
| 6,286,598 | B1 | 9/2001 | van Petegem et al. | |
| 6,386,288 | B1 | 5/2002 | Snider et al. | |
| 6,761,219 | B2 | 7/2004 | Snider et al. | |
| 6,817,298 | B1 | 11/2004 | Zharkov et al. | |
| 6,991,044 | B2 | 1/2006 | Zhang et al. | |
| 7,073,589 | B2 | 7/2006 | Tiernan et al. | |
| 7,284,612 | B2 * | 10/2007 | Ratanasirigulchai et al. | 166/297 |
| 7,353,866 | B2 * | 4/2008 | Snider et al. | 166/55.2 |
| 7,409,911 | B2 | 8/2008 | Tiernan et al. | |
| 7,413,015 | B2 | 8/2008 | McKinnon et al. | |
| 7,487,827 | B2 | 2/2009 | Tiernan | |
| 7,565,930 | B2 * | 7/2009 | Seekford | 166/297 |

(Continued)

*Primary Examiner* — Giovanna Wright
*Assistant Examiner* — Michael Wills, III
(74) *Attorney, Agent, or Firm* — Dorr, Carson & Birney, P.C.

(57) ABSTRACT

A fracturing system for wells has a propellant charge having a known surface area for combustion, and a combustion rate as a function of pressure with lower combustion rates at lower pressures and rapidly increasing combustion rates at higher pressures separated by a knee in the combustion rate function. The propellant charge is initially sealed within a vessel as it is inserted into a well. The system also includes means for creating openings in the vessel on ignition of the propellant charge in the well, such that the openings have a known combined flow area selected to create a condition of choked flow of combustion gases from within the vessel and maintain pressures within the vessel below the knee in the combustion rate function.

13 Claims, 8 Drawing Sheets

(56) References Cited

U.S. PATENT DOCUMENTS

| | | | | |
|---|---|---|---|---|
| 2001/0001418 | A1* | 5/2001 | Wesson | 166/297 |
| 2004/0129415 | A1 | 7/2004 | Xi et al. | |
| 2006/0048664 | A1* | 3/2006 | Tiernan et al. | 102/332 |
| 2006/0070739 | A1* | 4/2006 | Brooks et al. | 166/299 |
| 2006/0075890 | A1 | 4/2006 | Tiernan | |
| 2006/0185839 | A1* | 8/2006 | Tiernan | 166/63 |
| 2007/0240880 | A1* | 10/2007 | Olsen | 166/259 |
| 2008/0073081 | A1 | 3/2008 | Frazier et al. | |
| 2008/0105430 | A1 | 5/2008 | Cuthill | |
| 2008/0264289 | A1* | 10/2008 | Tiernan et al. | 102/322 |
| 2009/0260821 | A1* | 10/2009 | Seekford | 166/299 |

* cited by examiner

PROPELLANT FRACTURING SYSTEM FOR WELLS

RELATED APPLICATIONS

The present application is based on and claims priority to the Applicant's U.S. Provisional Patent Application 61/238,773, entitled "Perforating Gun With Propellant For Fracturing Wells," filed on Sep. 1, 2009; U.S. Provisional Patent Application 61/219,670, entitled "Propellant Fracturing System Having A Propellant Sleeve With Holes Inside A Carrier With Rupture Disks," filed on Jun. 23, 2009; U.S. Provisional Patent Application 61/183,176, entitled "Ignitable Plugs For Propellant Vessels Used In Fracturing Wells," filed on Jun. 2, 2009; U.S. Provisional Patent Application 61/172,615, entitled "Propellant Fracturing System With Flow Restrictions," filed on Apr. 24, 2009; and U.S. Provisional Patent Application 61/167,663, entitled "Propellant Fracturing System With Rupture Disk," filed on Apr. 8, 2009.

BACKGROUND OF THE INVENTION

Field of the Invention

The present invention relates generally to the field of systems for fracturing wells. More specifically, the present invention discloses a propellant system for fracturing wells with openings in the propellant vessel of known size to create a condition of choked flow of combustion gases from within the vessel with specific tailoring of flow rates to the well bore to maintain pressures within the vessel below the slope break in the combustion rate curve for the propellant.

Statement of the Problem

The majority of oil and gas wells in production worldwide are cased wells that require perforation to connect the hydrocarbon-producing formation containing the oil and gas to the inner well bore. This perforation of the casing and surrounding cement is completed using directed explosive shaped charges which are fired in a pattern through the casing and cement. The shaped charges also penetrate into the surrounding formation, increasing the effective well bore diameter. However the penetrating action of the shaped charge can also create damage to the formation, limiting its conductivity.

In order to extend the depth of penetration of the perforating charges and to fracture beyond the area of limited conductivity, others have devised systems using propellant charges to generate gas at high pressures to extend these penetrations. For example, the propellant charge can be formed as a sleeve around the outside of the perforating charge guns. There are systems in which wafers of propellant are deployed between the perforating charges to generate additional gas and penetration into the formation. Furthermore, there are propellant-only systems that are used following perforating, but these typically require an additional trip in hole for deployment, separate from the trip in hole to complete the perforating of the casing and cement.

These prior art systems all have limitations. One problem is developing a one-step perforating and propellant treatment system that treats well formations in one trip in-hole by controlling the exhaust gas efflux in such a way that the controlled burn maximizes formation fractures without damaging the carrier vessel or the surrounding well casing. The propellant should be configured such that all of the propellant burns in the desired manner, and the propellant burn can be characterized, designed and reproducibly controlled. Unless protected from well bore fluids, the burn characteristics of the propellant can be unpredictable. In addition, the propellant can ignite from shock and/or friction, and placing propellant in a well bore can subject it to impact with the well casing or other tooling components during the placement of the tool into position.

To achieve desired pressure loading rates and minimum pressures for sustained periods of time sufficient to extend fractures in oil, gas and water-bearing formations using propellants, it is necessary to design the propellants and related assemblies so that the burn and the corresponding mass flow rate of combustion gases that produce the desired pressure characteristics are controlled, reproducible, and predictable. Control of such burning is difficult within the well bore as the environment typically includes well bore fluids (i.e., water, salts, acids, hydrocarbons, or other fluids) that can negatively the impact burn rate, burn propagation, and can extinguish portions of the burning propellant grain. In addition, heat loss into the well bore fluids that occurs when propellants are burned in the presence of these fluids is substantial. Energy is lost to heating of the surrounding fluids rather than producing the desired pressure pulse to extend fractures within the oil, gas or water-bearing formation. Lower gas temperature reduces the pressurization capability of the propellant, and further energy loss can result in condensation of exhaust species that preclude them from providing any pressurization capability. Furthermore, the propellant burning and gas generation rates are implicitly dependent on the local well fluid pressure and cannot be controlled to any degree above the control of the transient fluid pressures. Propellant grains burned in the presence of well bore fluids do not burn in a controlled manner. Therefore, it is difficult to achieve the desired pressure rise times and peak pressures because ignition of burn areas is limited by well fluids and corresponding gas generation is therefore limited, resulting in slower pressure loading rates and peak pressures.

Ideally, a propellant grain with a known geometry is ignited over a known surface area and burned to produce a desired pressure pulse that is calculated based upon the propellant thermochemical properties, burning characteristics (i.e., burn rate at various pressures), propellant geometry, and effective nozzle flow area. Such propellant should be isolated from well bore fluids to assure proper initiation of the burn. Burn rates should be sufficient to generate gas to maintain pressures above that required for fracture extension for extended periods of time so that the maximum amount of chemical energy is converted into useful work on the formation. The resulting pressures should be sufficient to extend fractures in the formation, but also be capable of being designed to produce a range of pressures depending on the formation type.

At the other end of the pressure spectrum, the pressures produced by combustion of the propellant must also be limited to avoid damage to the perforating charge and propellant carrier vessel, as well as to avoid damage to other components of the tool string and the surrounding well. Thus, a balance must be struck. If too much propellant is burned too rapidly within the vessel, excessive pressure builds and the vessel becomes damaged or ruptures. On the other hand, reducing the amount of propellant reduces the amount of useful work that can be done in fracturing the formation surrounding the well bore.

In addition, many types of propellant have a combustion rate with two distinct combustion regions as a function of pressure. Propellant burning rates are characterized by the ballistic burn model ($r=k_1 P^e$) at pressures below the knee where the burn rate exponent, e, is less than one; and by Muraour's Law Model ($r=k_2+k_3*P$) above the knee. Operating in the latter region with any propellant type results in run-away combustion of the propellant, which can damage the vessel, well casing and/or the surrounding well formation.

Assuming choked flow conditions exist at the openings in the vessel, a substantial portion of pressure created by the combustion gases will be lost going through the openings. In order to sustain pressures that will do useful work on the formation, higher pressures must therefore be generated within the vessel. This is possible in a controlled manner if the pressure at which the knee for the propellant occurs at a pressure that is higher than desired peak pressure during the propellant burn within the vessel. Operating above the knee is theoretically possible, but any perturbations that increase pressure will drive the system back to an unstable condition where the openings in the vessel wall are too small and vessel rupture can occur. There are, however, a limited number of propellant types that will be suitable for this type of application. In other words, if a propellant is used having a knee transition point below this peak desired pressure within the vessel, the burn rate slope changes at the knee pressure and run-away deflagration will occur given a fixed flow area. One solution is to limit the amount of propellant in the vessel, but this can drastically limit the amount of useful work that can be done on the formation. Another possible approach is to employ a modulating valve with varying orifice size (and flow area) based on the amount of gas and pressuring being generated. However, such a modulating valve is much more complex. Another possible solution is to add rupture discs to increase the orifice size or quantity as certain higher pressures are reached, however this creates the opportunity for fluid invasion within the vessel, and adds significant complexity and cost to the system.

Solution to the Problem

The present invention addresses these shortcomings in the prior art by providing a one-step perforating charge and propellant fracturing system in which the propellant is housed within a vessel that initially protects the propellant from well bore fluids prior to ignition of the propellant. Openings of known area are created in the vessel on ignition of the perforating charges to provide a flow area that creates a condition of choked flow of combustion gases produced by the propellant burning within the vessel. The flow area for combustion gases in the present invention is selected to maintain pressures within the vessel in the lower region below the knee in the combustion rate function for the propellant. This prevents the propellant from entering the upper region and experiencing run-away combustion rates that could damage or rupture the vessel. This also provides a more stable system, not subject to pressure perturbations which can result in runaway deflagration and vessel rupture.

SUMMARY OF THE INVENTION

This invention provides a fracturing system for wells having a propellant charge that has a nearly linear combustion rate as a function of pressure with lower combustion rates at lower pressures and rapidly increasing combustion rates at higher pressures separated by a knee, or slope break, in the combustion rate function occurring at a known pressure. The propellant charge is initially sealed within a vessel as it is inserted into a well. The system also includes means for creating openings in the vessel on ignition of the propellant charge in the well, such that the openings have a known combined flow area selected to create a condition of choked flow of combustion gases from within the vessel and maintain pressures within the vessel below the knee in the combustion rate function. The means of creating these openings could be perforating charges also used to create perforations in the well casing.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
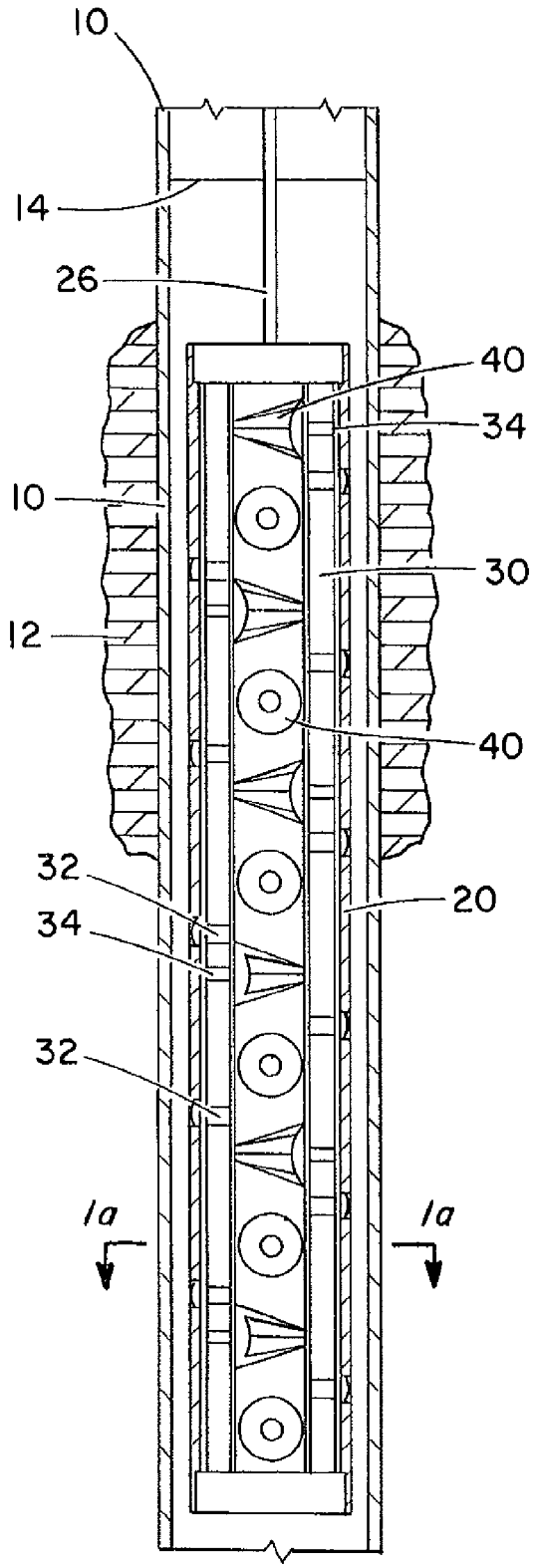
FIG. 1 is a vertical cross-sectional view of an embodiment of the present invention in which the perforating charges 40 are surrounded by an annular sleeve of propellant 30.
Figure 1A:
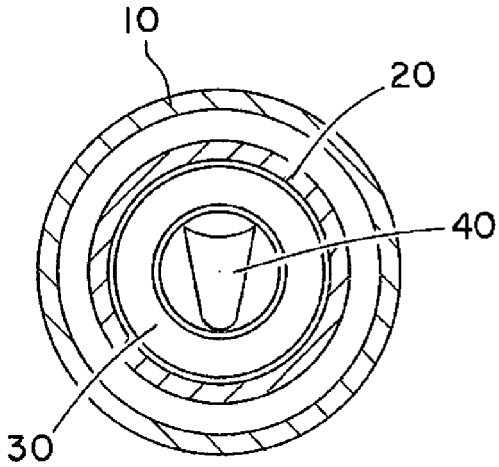
FIG. 1*a* is a horizontal cross-sectional view corresponding to FIG. 1.

FIG. 1 shows a vertical cross-sectional view of an embodiment of the present invention within a well casing 10. FIG. 1*a* is a horizontal cross-sectional view corresponding to FIG. 1. In this embodiment, a set of perforating charges 40 are surrounded by an annular sleeve of propellant 30 and enclosed within a tubular metal vessel or carrier 20. The vessel 20 is initially lowered to a desired depth in the well by means of a wire line or tubing 26. This is typically below the level of the fluid 14 in the well. During this initial phase (i.e., prior to firing the perforating charges 40 and igniting the propellant 30), the vessel 20 is a water-tight housing that completely encloses the propellant 30 and perforating charges 40 and protects them from physical damage and well fluids.

Detonating cord 45 can be used to initiate the perforating charges 40 as well as the propellant 30. Alternatively, the propellant 30 can be ignited by a separate blasting cap or electric match device. Initiation of the propellant 30 can be modulated using standard steel tubing around the detonating cord 45, if required. A conductor wire can be run through the vessel 20 for multiple perforating gun propellant shots to be performed at differing times during one trip in hole.

The perforating charges 40 can be used to create a series of openings in the wall of the vessel 20, as well as perforate the well casing 10. The openings in the wall of the vessel 20 have a known area allowing combustion gases produced by the propellant 30 to flow from within the vessel 20 into the well and surrounding formation. The perforating charges 40 can also be fired through the propellant 30 to thereby ignite the propellant 30, although this has disadvantages as will be discussed below.

In the embodiment shown in FIGS. 1 and 1*a*, a series of preformed openings 32 extend through the vessel 20 and propellant sleeve 30 to allow combustion gases produced by the propellant 30 to flow from the vessel 20 and into the well bore. Alternately, combustion gases produced by the propellant 30 flow through openings in the vessel 20 created by perforating charges.

The propellant 30 does not require coating since it is initially contained within a vessel 20. The absence of a coating enables the propellant 30 to burn as designed, not only at the cross-section of the sleeve geometry, but also over the entire surface area of the interior and exterior portions of the propellant sleeve 30 in addition to those cross-sectional areas where the gases flow out of the vessel. Since the propellant 30 is not residing in well fluids, nor does it require coating, the propellant characteristics are known and remain consistent over time. The containment vessel allows complete ignition of all desired burning surfaces and prevents well bore fluid from entering the containment vessel until the well bore fluid pressure exceeds the containment vessel pressure. This allows propellant burns to be modeled accurately. Burn areas are greater, thus gas production rates are greater.

In the embodiment shown in FIGS. 1 and 1*a*, and 4 and 4*a* the propellant 30 is deployed simultaneously with the perforating charges 40, and thereby avoids the need for two trips into the well 10. In addition, the propellant is burned in a controlled manner such that all of the propellant burns, the assembly is not damaged during the treatment and can be fully removed, and the propellant burn can be characterized, designed and controlled.

Proper modeling of the propellant treatment must take into account several factors, as will be discussed below. First, the number of openings and size and shape of the openings, which results in the total combined flow area or throat area for propellant gases to flow from the inside of the vessel 20 into the well bore, must be well defined. Second, the burn characteristics of the propellant must be well defined. Given the desired pressure to be obtained outside of the assembly within the well bore, and assuming a choked flow condition through the openings created by the perforating and propellant charges within the vessel, a specific propellant with proper burn characteristics and geometry is selected. Computer modeling can then be used to determine an appropriate propellant geometry/volume and flow area to achieve a design pressure profile within the well bore and surrounding formation.

Figure 2:
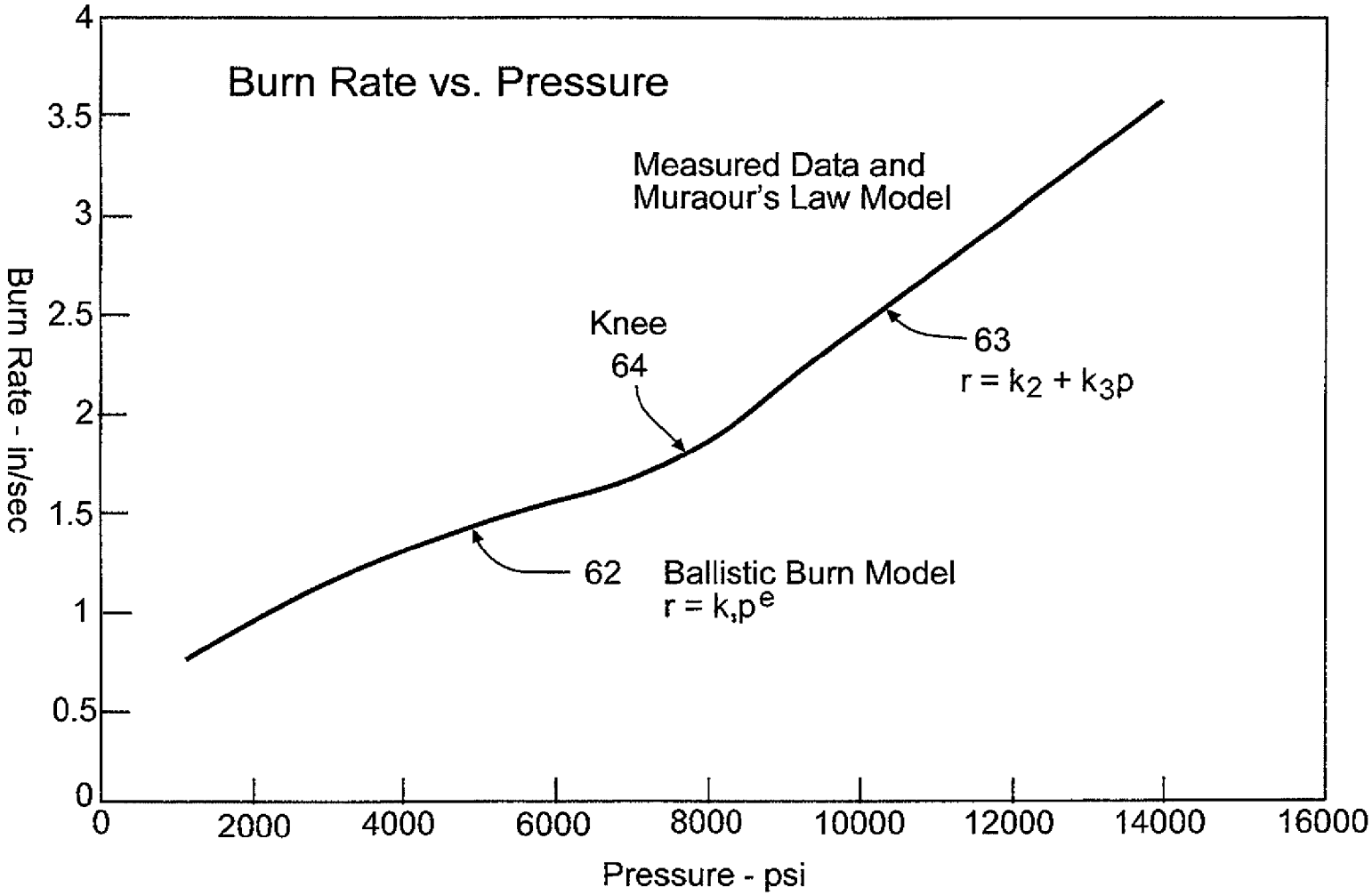
FIG. 2 is a graph showing the burn rate of a typical propellant as a function of pressure.
Figure 3:
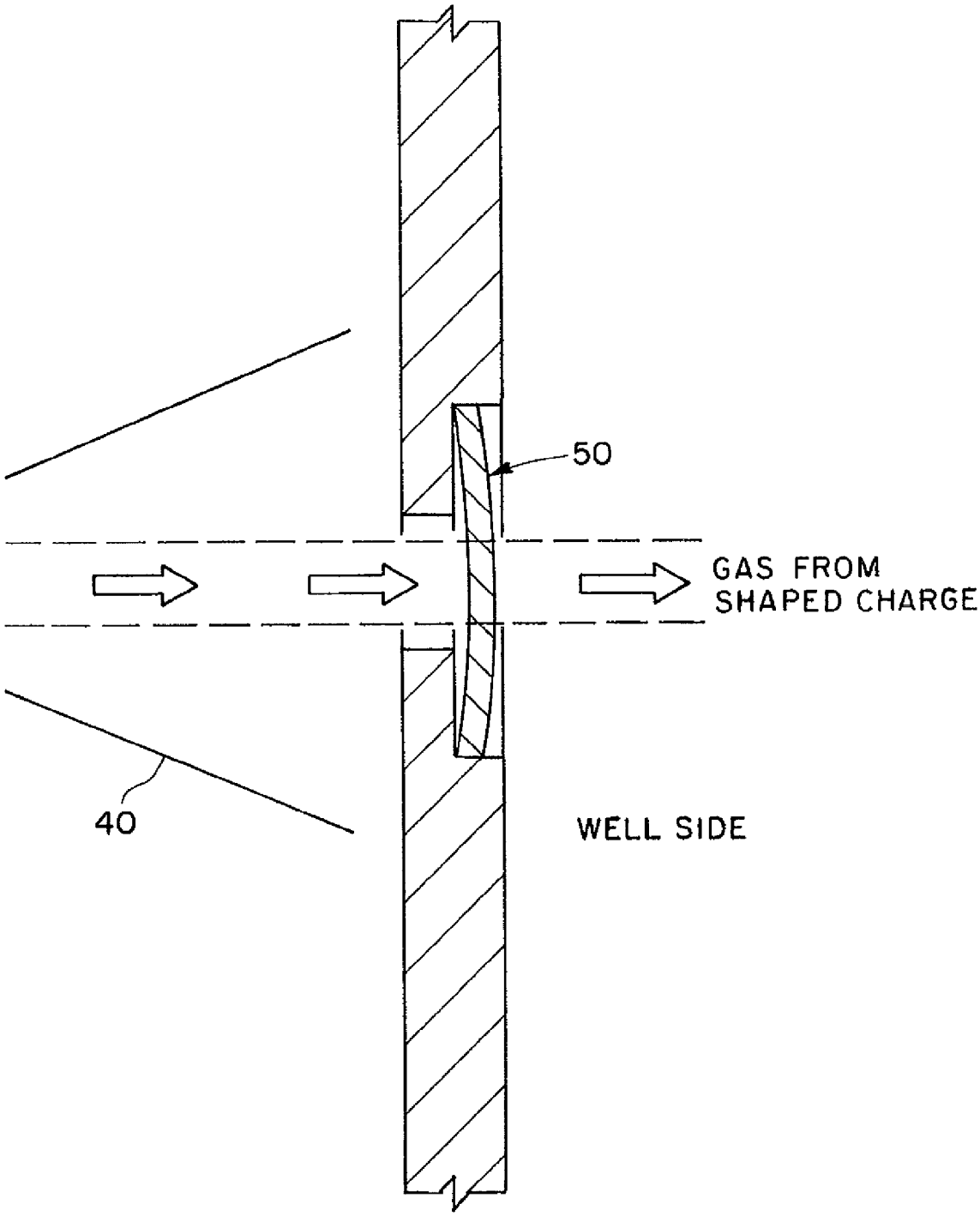
FIG. 3 is a detail cross-sectional view of an embodiment of the present invention in which a rupture disk 50 is used to initially seal an opening in the vessel prior to firing the perforating charges 40.

FIG. 2 is a graph showing the burn rate as a function of pressure for a typical propellant. In particular, many propellants have a combustion rate as a function of pressure with lower combustion rates 62 ($r=k_1*P^e$) at lower pressures and rapidly increasing combustion rates 63 ($r=k_2+k_3*P$) at higher pressures separated by a knee, or slope break 64 in the combustion rate function. In other words, this slope break or knee 64 is where a transition to more rapid deflagration or detonation occurs. In order to obtain gas generation at higher pressures, yet in a controlled manner, propellants with a high pressure knee 64 are optimal. The burst limit of the vessel is a function of the differential pressure between the inside and the outside of the vessel. The chamber pressure, or pressure within the vessel, must not be at or above the slope break or knee 64. If the chamber pressure exceeds the knee pressure, a runaway deflagration can take place causing a failure of the vessel. If the chamber pressure is below the knee 64, the burn characteristics are known and remain relatively constant for a fixed flow area, and the burn will be controlled and modelable. Furthermore, the desired pressure within the well bore must take into account the pressure losses that occur as the gases pass through the vessel wall flow area. Therefore, it is optimal that the knee 64 must exceed the desired pressure within the vessel, or the propellant quantity will require reduction, thus resulting in a lower energy treatment. For example, if the knee occurs at a pressure of approximately 10,000 psi, the propellant will transition to a rapid deflagration at this pressure. So if the flow area is too small to limit pressures to 10,000 psi, additional flow area is required to accommodate the additional gas production at this higher burn rate. Since it is impractical to increase the flow area after initiation of the perforating charges and propellant, then the best option is to use a propellant without a knee in the desired pressure regime within the vessel. Alternately, flow areas can be increased initially in anticipation of exceeding the knee pressure, but this creates other problems, namely: (1) additional flow area requires the addition of perforating charges, rupture discs, or the like, increasing complexity and cost; (2) if the flow area is too large, the pressure in the vessel may never exceed the knee slope break pressure, and peak pressures obtained will be reduced, resulting in lower sustained pressures and less than optimal treatment; (3) operating above the knee is theoretically possible, but any perturbations that increase pressure will drive the system back to an unstable condition where the openings in the vessel wall are still too small and vessel rupture can occur. Pressure losses across an orifice in a choked flow condition are substantial (typically on the order of 2:1). In order to achieve useful working pressures to effectively initiate and extend fractures within the well bore, propellants must be used that have knees which occur at relatively high pressures. If the knee 64 occurs at say 20,000 psi, flow areas can then be sized to obtain sustained pressures within the vessel 20 at a lower level, allowing a factor of safety to assure the vessel 20 does not fail. There are several other variables which must also be taken into consideration when designing the assembly including density, gravitational acceleration, $C_{star}$ (characteristic velocity), maximum burn area, free volume, opening diameter, flow coefficient thru the orifice, to name a few.

To summarize, the knee 64 for a propellant 30 is variable, depending on the chemical composition of the fuel oxidizer and the binder, and the ratio of fuel oxidizer to binder. Low rate propellants have a knee at as low as 2500 psi and higher rate propellants can push it to 20000 psi or greater. For ammonium perchlorate propellants, the knee of the curve is driven by the properties of ammonium perchlorate. This behavior applies to Arcite (PVC binder) and Arcadene (HTPB binder), among other propellants.

For example, Arcadene 439 propellant is known to have a knee that exceeds 14,000 psi, and based upon experience it is estimated to be around 21,000 psi. Optimally, the propellant should be selected to have a knee taking into consideration the ultimate tensile strength of the vessel.

The area of the aperture opening, or desired throat area ($A_t$), can be calculated as a function of the desired pressure (p) by taking into account several variables, namely: (1) the burning area as a function of distanced burned of the propellant, which is a function of the propellant geometry ($A_s$); (2) the burn rate characteristics of the propellant, more specifically, the burn rate as a function of pressure (r); (3) the density of the propellant (ρ); (4) the characteristic velocity of the propellant ($C_{star}$); (5) the gravitational constant (g); and (6) two efficiencies ($C_d$—discharge coefficient, and $C_e$—$C_{star}$ efficiency).

The burn rate of the propellant varies as a function of the pressure up to the knee, which is the point at which the burn rate typically increases. Up to the knee, the burn rate is approximated using the ballistic burn model equation, which takes the form:

$$r=k_1P^e$$

where $k_1$ (the pressure rate proportionally constant) and e (the burning rate exponent) are determined empirically from pressure bomb tests for any given propellant. The burn rate equation above the knee may fit the above form with e>1 or maybe approximated using Muraour's law, and takes the form:

$$r=k_2+k_3*P$$

where $k_2$ and $k_3$ are also determined empirically. The throat area ($A_t$) is calculated as follows:

$$A_t=(r\times A_s\times\rho\times C_{star})/(p\times g)$$

This is the throat area without taking into consideration the friction losses thru the orifice. A discharge coefficient (f) is then applied to take these losses into consideration. The discharge coefficient is determined empirically for any given opening size and shape taking into account measured $C_d$ and $C_{star}$ efficiency. Given the throat area $A_t$, and applying the discharge coefficient, the desired throat area $A_d$ is then determined by the following equation:

$$A_d=A_t/f$$

For a circular opening, the area (A) is calculated using orifice diameter (θ) by the equation:

$$A=\pi\times\theta^2/4$$

Accordingly, the orifice diameter (θ) to achieve the desired peak pressure can then be calculated using the equation:

$$\theta=((A_d\times4)/\pi)^{1/2}$$

Because the burn rate changes at the propellant's characteristic knee, it is desirable to have a propellant with a knee occurring at a pressure exceeding the desired peak pressure within the vessel, otherwise the change in the burn rate at the knee can cause excessive pressurization of the vessel, as the aperture opening size is typically fixed during any given propellant burn event.

In addition to limiting pressures within the vessel 20, it is important to model the resulting pressures created within the well bore by the combustion gases produced by the propellant charge 30. In particular, the combustion process must produce adequate pressures and corresponding loading rates to initiate fractures in the surrounding formation 12, and produce such pressures for extended periods of time so that fractures are extended. Furthermore, pressures within the well bore must be limited to assure there is no resulting damage to the tool assembly, well bore casing 10 or surrounding formation 12. Pressures within the well bore are also used to establish the differential pressure between the inside of the vessel and the well bore.

The pressures within the well bore 10 and external to the vessel 20 can be modeled and controlled by applying the concept of choked flow, that is, flow of any fluid being limited to the speed of sound in that fluid. For example, propellant 30 within the vessel 20 might produce pressures within the vessel 20 of 9,000 psi. Perforating charges 40 can be sized to create a choked flow condition whereby the pressures outside the vessel 20 and within the well bore 10 are limited to 2,500 psi. The pressure outside of the vessel 20 is limited by the flow rate restriction which is a function of the quantity and size of the openings in the vessel 20. The area of the openings can be designed with a computer program based on the propellant burn characteristics, such that the pressure produced by the gas within the vessel does not exceed the vessel burst strength, while providing the desired pressure change to control the pressure outside of the vessel.

Propellant 30 of known geometry and surface area is placed and ignited to burn to create certain pressures within the vessel 20. The propellant 30 is located around the perforating charges 40 (and optionally, also above and below the perforating charges 40), with openings in the vessel 20 located to direct the gas flow in the area where perforating is taking place. The pressure rise time outside of the vessel 20 is proportional to the net difference in mass generation minus mass discharge. The burning rate, $r=k_t*P^e$, is the main driver on gas and corresponding pressure generation, but the net rise rate is dominated by the throat area $A_t$, or the total area of openings in the vessel 20, as provided in the following equation:

$$P_{dot}=\left(\rho_p*A_s*k_1*P^e\frac{P*g_c*Al}{Cstar}\right)*\frac{Rg*T}{V}-\frac{A_s*k_1*P^e}{V}$$

where $\rho_p$ is propellant density, $A_s$ is burning area and is a function of distance burned, $k_1$ is the pressure (P)—rate proportionality constant, e is the burning rate exponent, $g_c$ is constant, At is actual effective flow area, $C_{star}$ is characteristic velocity, $R_g$ is specific gas constant, T is gas temperature, and V is volume.

One difficulty associated with the use of perforating charges 40 is to assure that the flow area for openings through the wall of the vessel 20 is well-defined, so that the desired pressures inside and outside the vessel 20 can be accurately modeled. Perforating charges 40 create perforations of varying size and shape, however flow coefficients for various perforating charges can be determined empirically for varying vessel types and/or wall thicknesses. If additional flow area is required in excess of the perforations created by the perforating gun, additional rupture disks and flow areas can be added to the vessel 20, however this solution complicates the deployment. Additionally, if a reduced flow area is required, a valve arrangement can be added to close a desired number of openings created by the perforating charges to achieve the desired pressures. However, this also complicates deployment.

Figure 4:
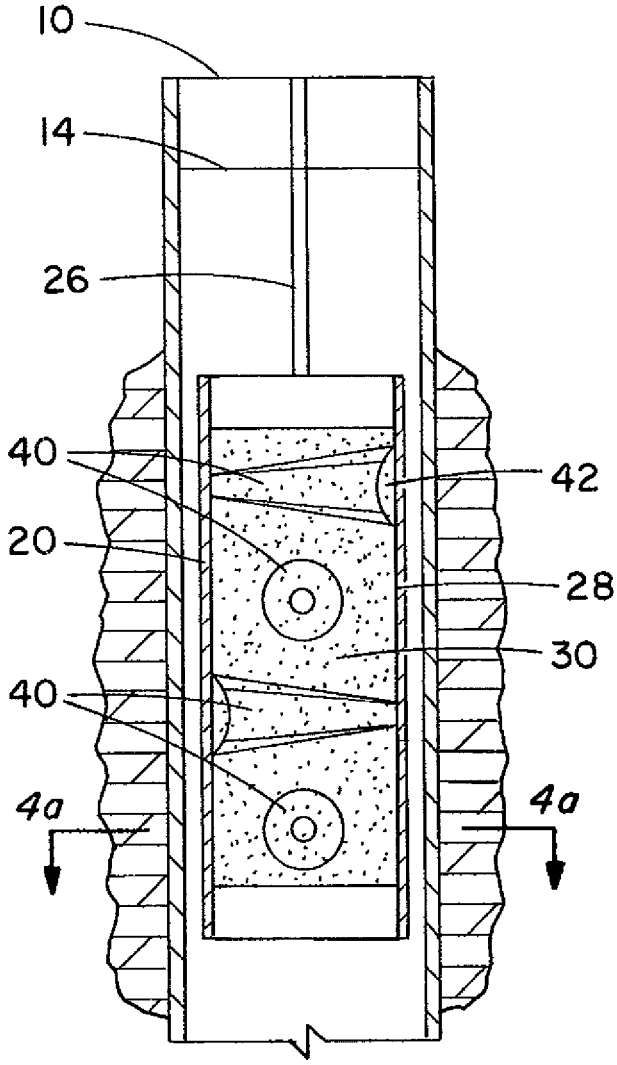
FIG. 4 is a vertical cross-sectional view of an embodiment of the present invention in which the perforating charges 40 are embedded in the propellant grain 30.
Figure 4A:
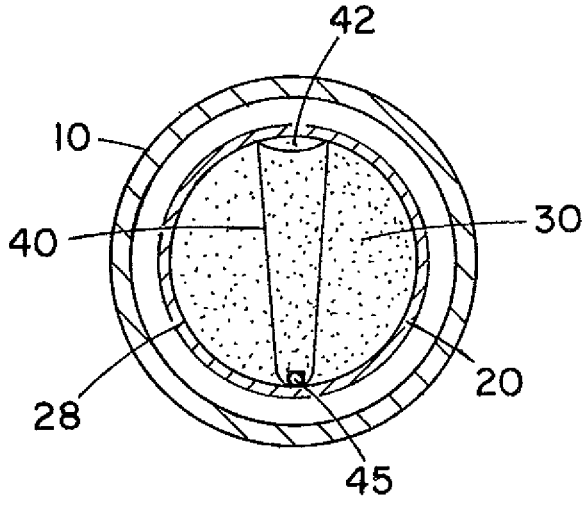
FIG. 4*a* is a horizontal cross-sectional view corresponding to FIG. 4.

FIGS. 4 and 4*a* are two orthogonal cross-sectional views of an alternative embodiment of the present invention in which the propellant 30 has been cast around the perforating charges 40 within the vessel 20. By casting the propellant 30 in this manner, the volume of propellant 30 is maximized as it includes nearly all of the void volume within the vessel 20 surrounding the perforating charges 40. Care must be taken to allow flow area for the combustion gases to exit the vessel through the opening created in the vessel wall. Thus, propellant cannot occupy all of the void volume of the vessel. This provides optimal control on the propellant burn as all propellant is burning within a closed control volume, isolated from the well fluids within the perforating charges.

The perforating charges 40 fire through the wall of the vessel 20 to create openings of a predetermined size. The perforating charges 40 can be sized and spaced to limit the outflow of gas resulting in a choked flow condition such that a predetermined well bore pressure will not be exceeded, and pressures within the vessel 20 remain below the knee in the burn rate curve for the propellant 30. The propellant 30 is ignited within the gun using an isolated detonating cord 45, or by using the same cord as is used to ignite the perforating charges 40. The perforating charges 40 can be used to create openings in the vessel 20, or, although not ideal, openings can be preformed in the wall of the vessels in front of each perforating charge 40. The propellant burn can be modeled, as previously discussed, to allow the design of optimal pressures within the vessel 20 and within the well bore based on formation requirements.

Figure 5:
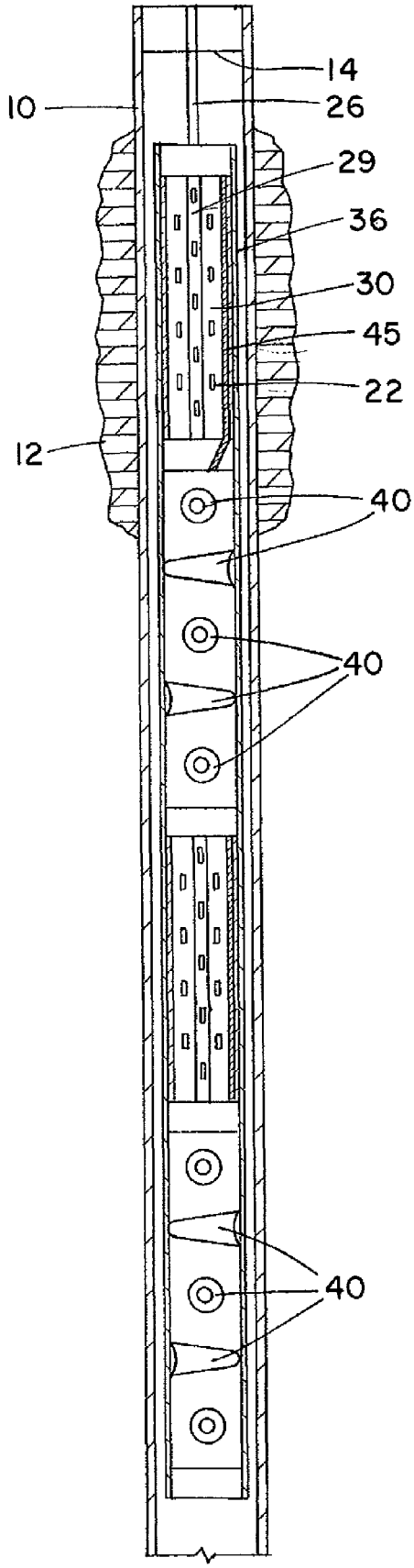
FIG. 5 is a vertical cross-sectional view of an embodiment of the present invention in which propellant charges 30 are held within a vessel 20 having weakened areas 22 designed to fail in a predictable manner.
Figure 5A:
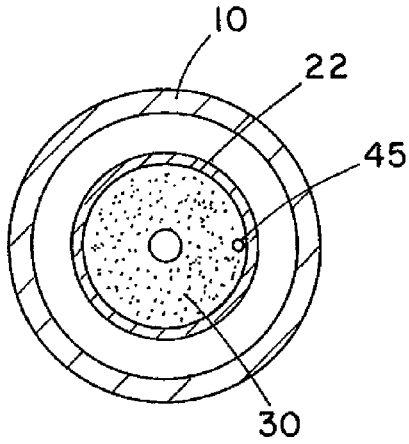
FIG. 5*a* is a horizontal cross-sectional view corresponding to FIG. 5.

FIGS. 5 and 5*a* are two orthogonal cross-sectional views of another embodiment of the present invention in which selected portions of the wall of the vessel 20 are designed to rupture or fail in a controlled manner and create openings 22 with a well-define flow area for the escape of combustion gases. The vessel 20 is made of material with a known ultimate yield stress. The pressure vessel can be designed to fail at predetermined opening locations at a known pressure by modifying the wall thickness of selected areas 22 of the vessel 20. The vessel rupture areas can be designed to withstand normal well bore pressures encountered within the well in one direction, while failing in the opposite direction at different failure pressures. This failure pressure can be achieved by routing weakened areas 22 in the vessel wall. The vessel 20 also acts as the carrier device for containing and transporting the propellant 30 into the well bore. The propellant 30 is configured with a known initial surface area and with a known geometry to generate gas at a desired rate. Propellant 30 is ignited in any one of many ways including blasting cap, detonating cord, trigger charge, or electronically with a fuse. Mass flow rates and corresponding pressures can be progressive, regressive, or constant, depending upon propellant geometries and burn rate characteristics. Because there is no pressure change in the well bore until the weakened areas of the vessel 20 fail, the pressure rise in the well bore is virtually instantaneous when the vessel 20 bursts, and pressure rises to a predetermined value. However, based on propellant burn geometry, the pressure is limited such that the burst pressure of the vessel 20 is not exceeded for a time period long enough to cause damage to the well casing 10. The total rupture area of the vessel wall is also calibrated. Flow area is an important part of the calculation, in correspondence with burn geometry, because flow area has an impact on the internal pressures within the vessel.

The vessel 20 can be a steel tube, as shown in FIG. 5, having an inner combustion chamber 36 that initially isolates the propellant 30 from well fluids. Following ignition of the propellant 30, gases are generated and ruptures occur on the vessel wall at a predetermined failure pressure. The number of rupture points is calculated to provide a total flow area to maintain the design criteria discussed above. A structural tube 29 can extend vertically through the vessel to ensure structural integrity of the assembly after the vessel wall ruptures. Because the pressure within the vessel 20 exceeds that surrounding the vessel within the well bore, the propellant 30 stays dry to the point of failure of the vessel, assuring proper ignition. Burn geometry and number of ruptures or aperture flow area can be modified to achieve a desired gas outflow depending on well conditions. The effective flow area can be calculated from the analytical procedures discussed above. The output pressure in the well bore is directly related to the mass flow rate from the vessel 20, which is controlled by the surface area history of the propellant grain, the burning characteristics of the propellant, and the flow area out of the vessel. Thus the pressures produced are known, predictable, and can be modeled more accurately.

Figure 6:
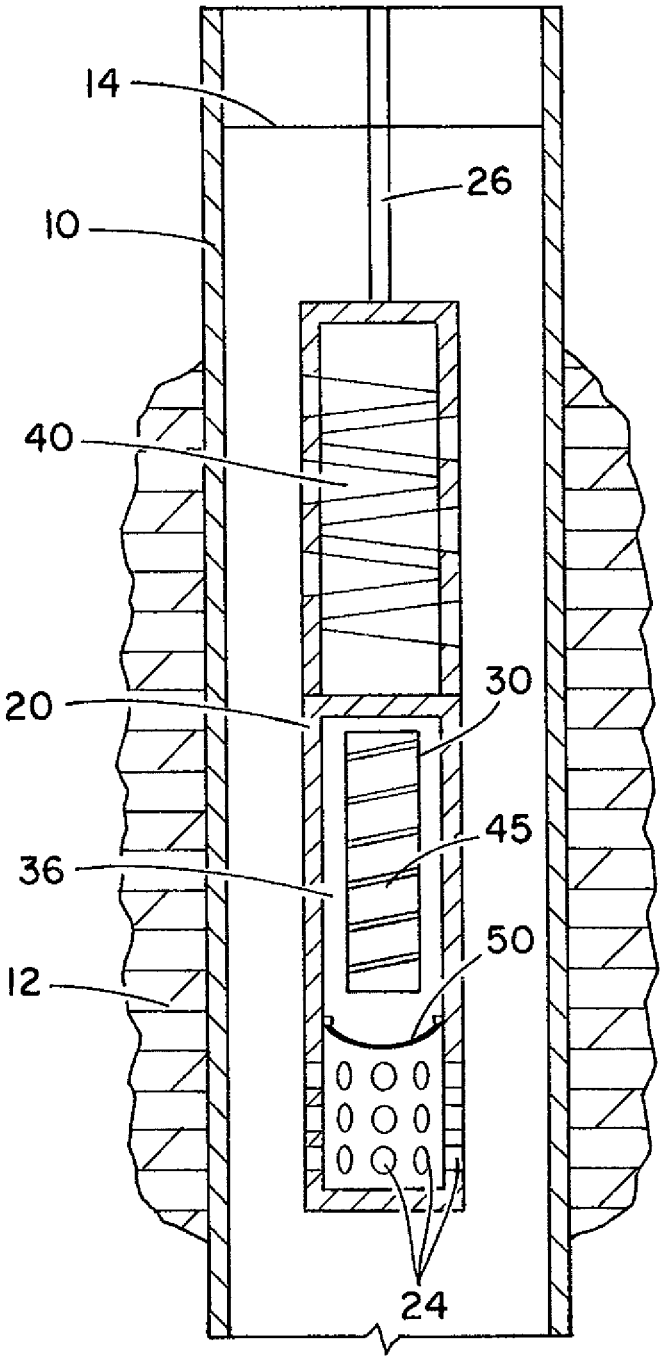
FIG. 6 is a cross-sectional view of another embodiment of the present invention using a rupture disk 50 to initially protect propellant 30 from well fluids.

A further embodiment is reflected in FIG. 6, which employs a single chamber in which the propellant is ignited and burned, with a rupture disk 50 that separates the well fluids from the propellant burn chamber 36 prior to ignition of the propellant 30. The rupture disk 50 is designed to resist hydrostatic well pressures in one direction, but to fail at a desired pressure in the opposite direction resulting from the pressure developed by burning the propellant 30. Gas flows from the propellant burn chamber 36 through the opening created at the rupture disk 50 and out of the flow ports 24.

The rupture disk orifice can be sized in two ways. Given a desired disk rupture pressure, one way is to maximize the disk size to allow maximum gas flow into the area where the flow ports exist. The flow ports 24 are then sized to develop the desired pressure in the burn chamber, and thus desired output pressure developed in the well bore. A second approach is to size the disk 50 to rupture at a desired propellant chamber pressure, and to size the rupture disk flow area to develop the desired pressure in the burn chamber. In this second system, the size of the flow ports 24 is maximized and the port created after rupture of the disk 40 is sized for the desired burn chamber pressures. Thus, the rupture disk 50 is sized to break at a desired differential pressure, flow is limited to burn within the chamber at a desired pressure, and taking into account pressure losses across the orifice, desired pressures within the well bore are obtained.

Note that another important element is to assure that there is not a rapid negative pressure change due to too high of a rupture disk rupture pressure for the area of propellant burning at rupture and the related orifice flow area. If the area of burning propellant at the time of rupture is not providing a significant enough mass flow based upon the flow area, there could be an extinguishment of the propellant 30 due to a negative change in pressure that will yield negative results.

Figure 7:
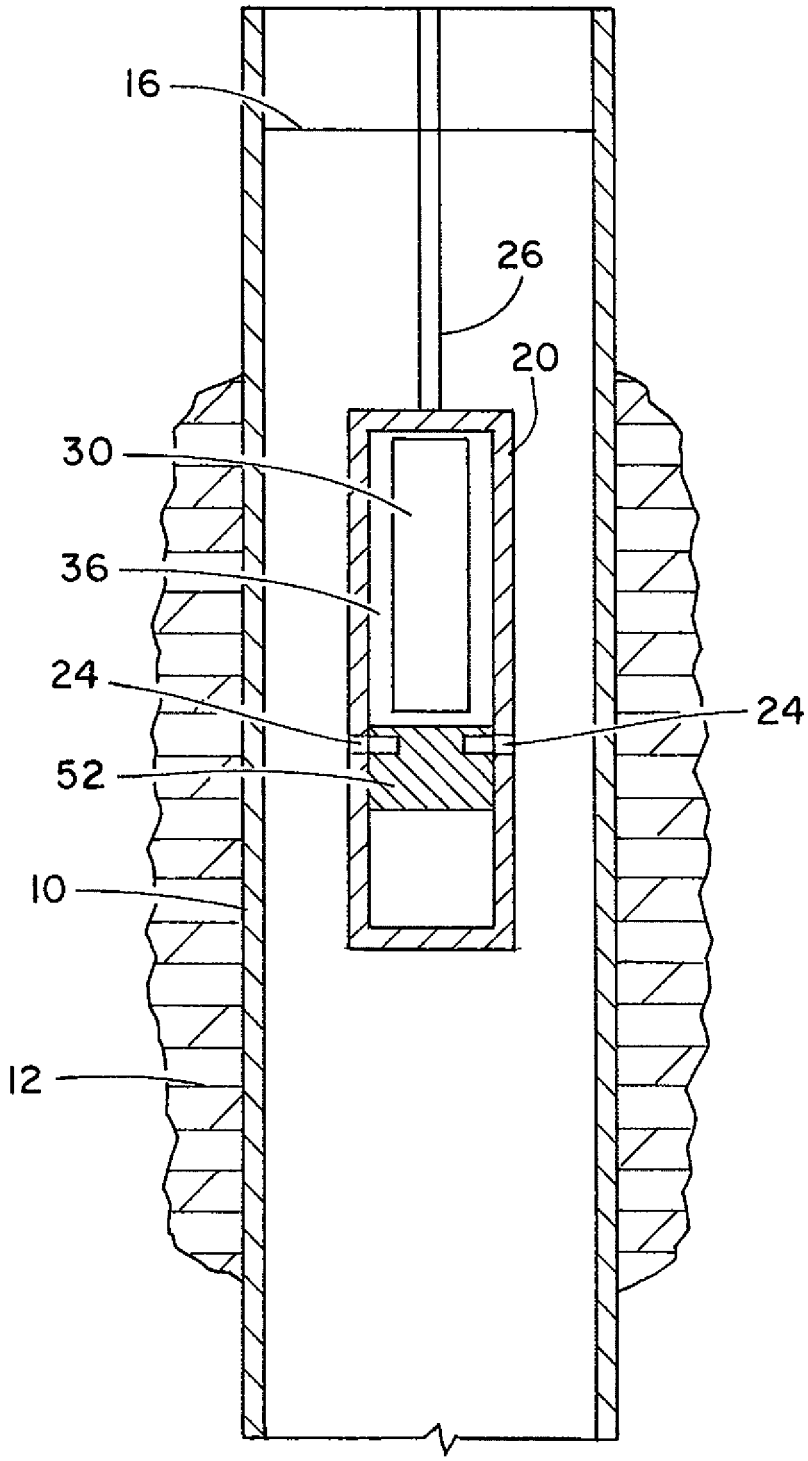
FIG. 7 is a cross-sectional view of an embodiment of the present invention using a pressure-actuated valve 52 to initially protect the propellant 30 from well fluids.
Figure 7A:
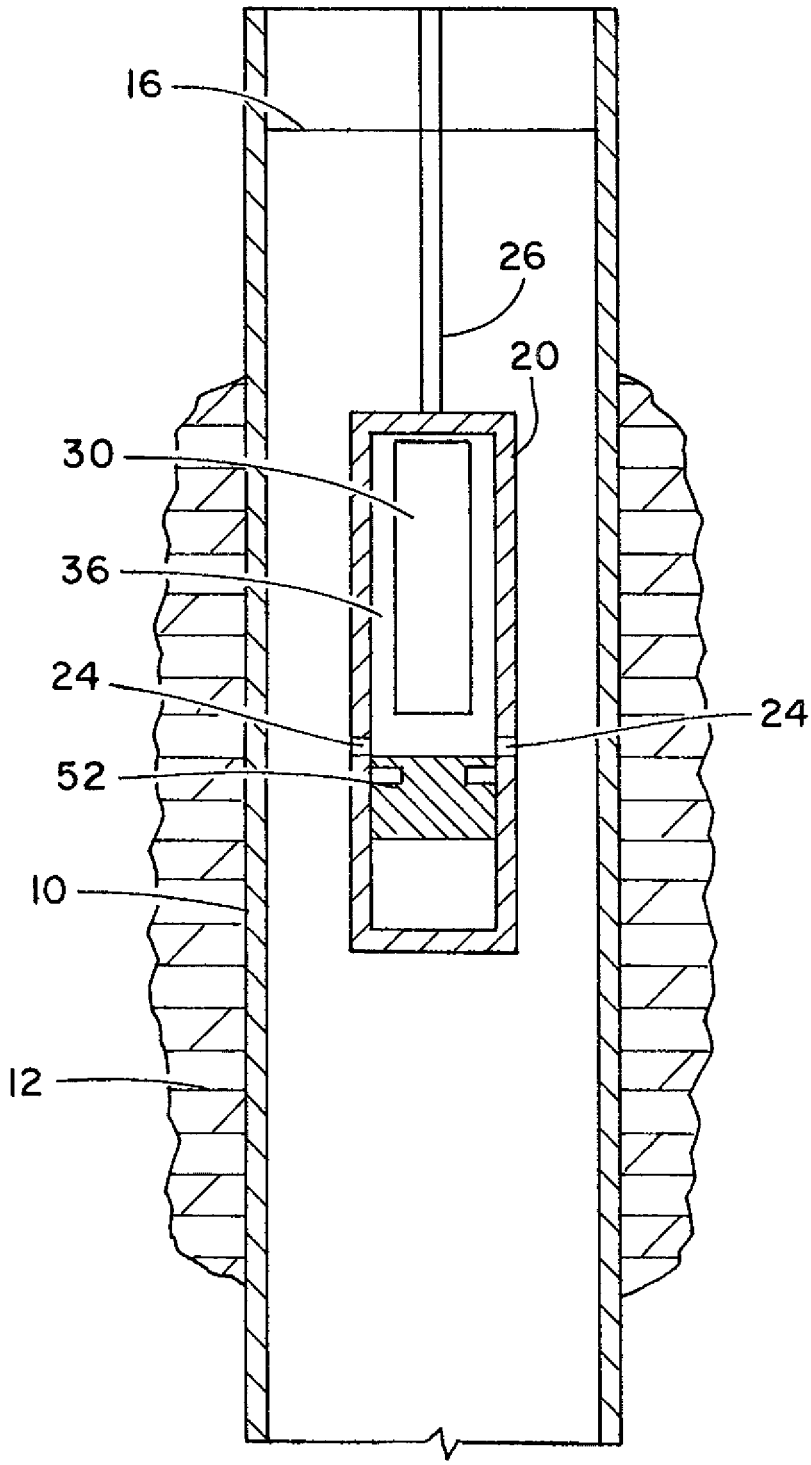
FIG. 7*a* is a cross-sectional view corresponding to FIG. 7 after the gas pressure generated by combustion of the propellant 30 has pushed the valve 52 downward to open the flow apertures 24 in the vessel 20.

FIGS. 7 and 7*a* are cross-sectional views of a further embodiment of the present invention that uses a pressure-actuated control valve 52 to control the flow area of the openings 24 based upon a desired output pressure regime. The propellant 30 is burned in the propellant burn chamber 36 within the vessel 20. FIG. 7 details the valve 52 in the initial closed position. The piston sealing the burn chamber 36 can be designed with a heat-resistant head. The chamber defined by the lower portion of the vessel below the piston is pressurized to provide the appropriate resistive force to hold the valve 52 in its closed position until the desired discharge pressure is reached. When the pressure in the upper burn chamber 36 reaches the desired discharge pressure, the valve 52 moves to its open position, as shown in FIG. 7*a*, allowing propellant gas to flow from the propellant chamber, out of the openings 24, and into the well bore. The valve 52 can be designed to vary the aperture openings 24 to control the discharge pressure.

Another embodiment of the present invention employs ignitable plugs in preformed openings in the vessel wall that are ignited during the propellant treatment and burn up, or are burned as a result of the perforating charges firing through the plugs. The plugs seal the openings in the vessel wall during initial insertion of the assembly into the well, and therefore should have the strength to withstand hydrostatic pressures typically encountered in well bores being treated (e.g., up to 10,000 psi). The plugs should maintain this strength at temperatures typically encountered in most well bores (i.e., 300 to 400 degrees F.). The residue left from the burn should preferably be small enough to prevent tooling from becoming stuck in the well bore.

For example, porous aluminum can be shaped into a plug. The porous aluminum is then filled with small iron oxide particles. The plug is then coated with an epoxy sealant, or thin layer of magnesium to seal it. When subject to high temperature (e.g., by firing a shaped charge), the plug is ignited. There is a thermite reaction, and the aluminum and iron oxide react to burn up. The heat also acts on the epoxy and/or magnesium to burn it up. Alternatively, other combinations of thermite materials could be employed, such as palladium aluminum.

Another embodiment includes a propellant fuel oxidizer combination mixed in a PVC binder. The propellant is heated to its melting point and under pressure is forced into the porous aluminum plug (in lieu of iron oxide particles). The plug can also be coated with a layer of magnesium and/or epoxy to form a seal. When subject to high temperature, the plug ignites and burns up.

Yet another embodiment includes a propellant fuel/oxidizer combination mixed in an epoxy binder. The epoxy/propellant is forced under pressure into the porous aluminum. The epoxy provides added strength to the plug. When the plug is heated (or fired upon by a shaped charge), the plug ignites and burn away. The plug could also be fabricated by molding, and could be reinforced with thin fibers of steel or fiberglass, or the plug can be made of a composite epoxy/propellant mix.

Yet another embodiment includes a propellant fuel/oxidizer combination mixed in an epoxy binder. The epoxy/propellant is forced under pressure into porous aluminum. The aluminum is shaped into a vessel carrier which acts to isolate the propellant and perforating charges from the well bore fluids. In this embodiment, the vessel may be comprised entirely of a composite epoxy/propellant, with no other material, depending upon design criteria. When the vessel is heated (or fired upon by a shaped charge), the entire vessel ignites and burns away.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

We claim:

1. A fracturing system for a well comprising:

a propellant charge having a known surface area for combustion, and having a combustion rate as a function of pressure with lower combustion rates at lower pressures and rapidly increasing combustion rates at higher pressures separated by a knee in the combustion rate function;

a vessel for insertion into a well with the propellant charge initially sealed within the vessel; and means for creating openings in the vessel on ignition of the propellant charge in the well, wherein the openings have a combined flow area selected to create a condition of choked flow of combustion gases produced by the propellant charge from within the vessel and maintain pressures within the vessel below the knee in the combustion rate function.

2. The fracturing system of claim 1 wherein the means for creating openings in the vessel comprises a perforating charge.

3. The fracturing system of claim 1 wherein the means for creating openings in the vessel comprises a rupture disk in the vessel.

4. The fracturing system of claim 1 wherein the means for creating openings in the vessel comprises a pressure-actuated valve through the vessel.

5. The fracturing system of claim 1 wherein the means for creating openings in the vessel comprises a weakened area in the vessel.

6. The fracturing system of claim 1 wherein the means for creating openings in the vessel comprises an ignitable plug in a preformed opening in the vessel.

7. A fracturing system for a well comprising:

a propellant charge having a known surface area for combustion, and having a combustion rate as a function of pressure with lower combustion rates at lower pressures and rapidly increasing combustion rates at higher pressures separated by a knee in the combustion rate function;

a vessel for insertion into a well with the propellant charge initially sealed within the vessel; and perforating charges for creating openings in the vessel and perforating the well, wherein the openings have a combined flow area selected to create a condition of choked flow of combustion gases produced by the propellant charge from within the vessel and maintain pressures within the vessel below the knee in the combustion rate function.

8. The fracturing system of claim 7 wherein the perforating charges are within the vessel and perforate the vessel to create the openings.

9. The fracturing system of claim 7 wherein the perforating charges are mounted in preformed openings in the vessel and allow combustion gases produced by the propellant charge to flow from the vessel after the perforating charges have been fired.

10. A fracturing system for a well comprising:

a propellant charge having a known surface area for combustion, and having a combustion rate as a function of pressure with lower combustion rates at lower pressures and rapidly increasing combustion rates at higher pressures separated by a knee in the combustion rate function;

a vessel for insertion into a well with the propellant charge initially sealed within the vessel; and means for creating openings in the vessel in response to pressure created by combustion gases after ignition of the propellant charge, wherein the openings have a combined flow area selected to create a condition of choked flow of combustion gases produced by the propellant charge from within the vessel and maintain pressures within the vessel below the knee in the combustion rate function.

11. The fracturing system of claim 10 wherein the means for creating openings in the vessel comprises a rupture disk in the vessel.

12. The fracturing system of claim 10 wherein the means for creating openings in the vessel comprises a pressure-actuated valve through the vessel.

13. The fracturing system of claim 10 wherein the means for creating openings in the vessel comprises a weakened area in the vessel.

* * * * *